US012584495B2

(12) United States Patent
Stephens et al.

(10) Patent No.: US 12,584,495 B2
(45) Date of Patent: Mar. 24, 2026

(54) KEYLESS NESTING DIFFUSER FOR CENTRIFUGAL PUMPS

(71) Applicant: Baker Hughes Oilfield Operations LLC, Houston, TX (US)

(72) Inventors: Kyle Stephens, Claremore, OK (US); Brett Williams, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 148 days.

(21) Appl. No.: 18/140,487

(22) Filed: Apr. 27, 2023

(65) Prior Publication Data

US 2024/0360841 A1 Oct. 31, 2024

(51) Int. Cl.

| | |
|---|---|
| ***F04D 29/44*** | (2006.01) |
| ***F04D 13/10*** | (2006.01) |
| ***F04D 29/42*** | (2006.01) |
| ***F04D 29/62*** | (2006.01) |

(52) U.S. Cl.

CPC ..... *F04D 29/445* (2013.01); *F04D 29/426* (2013.01); *F04D 29/628* (2013.01); *F04D 13/10* (2013.01)

(58) Field of Classification Search

CPC .... F04D 29/445; F04D 29/448; F04D 29/426; F04D 29/628; F04D 13/10; F04D 1/06; F04D 1/063; F04D 29/62

See application file for complete search history.

(56) References Cited

U.S. PATENT DOCUMENTS

| | | | | |
|---|---|---|---|---|
| 8,043,051 | B2 * | 10/2011 | Brunner | F04D 1/063 415/170.1 |
| 11,377,939 | B1 * | 7/2022 | Ye | E21B 43/128 |
| 2010/0037616 | A1 | 2/2010 | Twell | |
| 2020/0263703 | A1 * | 8/2020 | Hill | F04D 29/44 |
| 2021/0048029 | A1 | 2/2021 | Ye et al. | |
| 2021/0140436 | A1 | 5/2021 | Ye et al. | |

OTHER PUBLICATIONS

International Search Report and Written Opinion for PCT/US2024/026667 mailed Jul. 23, 2024.

* cited by examiner

*Primary Examiner* — Nathan C Zollinger
(74) *Attorney, Agent, or Firm* — Baker Hughes Company

(57) ABSTRACT

Multistage centrifugal pumping systems include a plurality of pump stages contained within a pump housing. Each stage typically includes a stationary diffuser and a rotatable impeller. Each of the diffusers includes a projection and a receiver that cooperate with the corresponding projection and receiver on adjacent diffusers to form a nested relationship between the diffusers that prevents the diffusers from rotating inside the pump housing. The projections have a projection outer surface with a non-circular shape. The receivers include a receiver inner surface with a complementary non-circular shape. The engagement between the non-circular projection outer surface and the non-circular receiver inner surface locks the adjacent receivers in fixed rotational alignment.

15 Claims, 5 Drawing Sheets

KEYLESS NESTING DIFFUSER FOR CENTRIFUGAL PUMPS

FIELD OF THE INVENTION

This invention relates generally to the field of pumping systems, and more particularly, but not by way of limitation, to a pumping system that includes rotationally fixed, nested diffusers.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the petroleum fluids from the subterranean reservoir to a storage facility on the surface. The pump assemblies often employ axially and centrifugally oriented multi-stage turbomachines. Each of the components in a submersible pumping system must be engineered to withstand the inhospitable downhole environment.

Most downhole turbomachines include one or more impeller and diffuser combinations, commonly referred to as "stages." The impellers rotate within adjacent stationary diffusers. A shaft keyed only to the impellers transfers mechanical energy from the motor. During use, the rotating impeller imparts kinetic energy to the fluid. A portion of the kinetic energy is converted to pressure as the fluid passes through the downstream diffuser. To reduce wear and improve efficiency, it is important to minimize surface-to-surface contact between the spinning impeller and the stationary diffusers.

The diffusers and impellers are typically contained within the pump housing. During manufacture, each diffuser-impeller stage is stacked inside the pump housing. After stacking the requisite number of diffusers into the housing, a compression sleeve may be used to provide a standard spacing between the diffusers during operation. During the compression process, however, the side walls of the diffusers tend to deform, thereby compromising the structural and operational characteristics of the diffuser. Furthermore, metal fatigue, temperature variances and mechanical shock can reduce the captured compression and allow diffusers to rotate within the pump housing. Such spinning causes localized heating, inefficient pumping, and can result in failure of the pump housing.

In the past, pump manufactures have used a slot-and-key arrangement to rotationally fix the diffusers to one another and the pump housing. Although generally effective at preventing the rotation of diffusers, the slot-and-key connections can weaken the pump components, create fluid interference and turbulence, and increase the manufacturing and assembly costs. There is, therefore, a need for an improved system for maintaining the stationary position of diffusers within the pump housing. It is to these and other deficiencies in the prior art that the present disclosure is directed.

SUMMARY OF THE INVENTION

Embodiments disclosed herein are generally directed at improved diffusers for use in a pumping system. The diffusers each include a first end, a second end, and a central portion between the first end and the second end. The diffusers further include a projection on the first end and a receiver on the second end. The projection has a projection inner surface and a projection outer surface, where the projection outer surface has a non-circular shape. The receiver includes a receiver outer surface and a receiver inner surface. The receiver inner surface has the same non-circular shape as the projection outer surface.

In other embodiments, the present disclosure is directed at a pumping system that has a motor and a pump driven by the motor. The pump includes a housing and first and second pump stages inside the housing. The pump further includes a first impeller and a first diffuser within the first pump stage, where the first diffuser has a first end, a second end, and a projection on the second end. The projection has a projection outer surface that has a non-circular shape. The pump also includes a second impeller and a second diffuser within the second pump stage, where the second diffuser has a first end, a second end, and a receiver on the first end. The receiver includes a receiver inner surface that has a non-circular shape that is complementary to the non-circular shape of the projection outer surface of the first diffuser, which permits the projection of the first diffuser to nest within the receiver of the second diffuser such that the first diffuser cannot rotate with respect to the second diffuser.

In yet other embodiments, the present disclosure is directed to a pump for use within a pumping system, where the pump includes a first stage and a second stage adjacent to the first stage. The first stage includes a first impeller and a first diffuser, and the second stage includes a second impeller and a second diffuser. The first diffuser and second diffuser each include means for nesting the first diffuser and second diffuser together in a rotationally fixed arrangement within the pump.

WRITTEN DESCRIPTION

Figure 1:
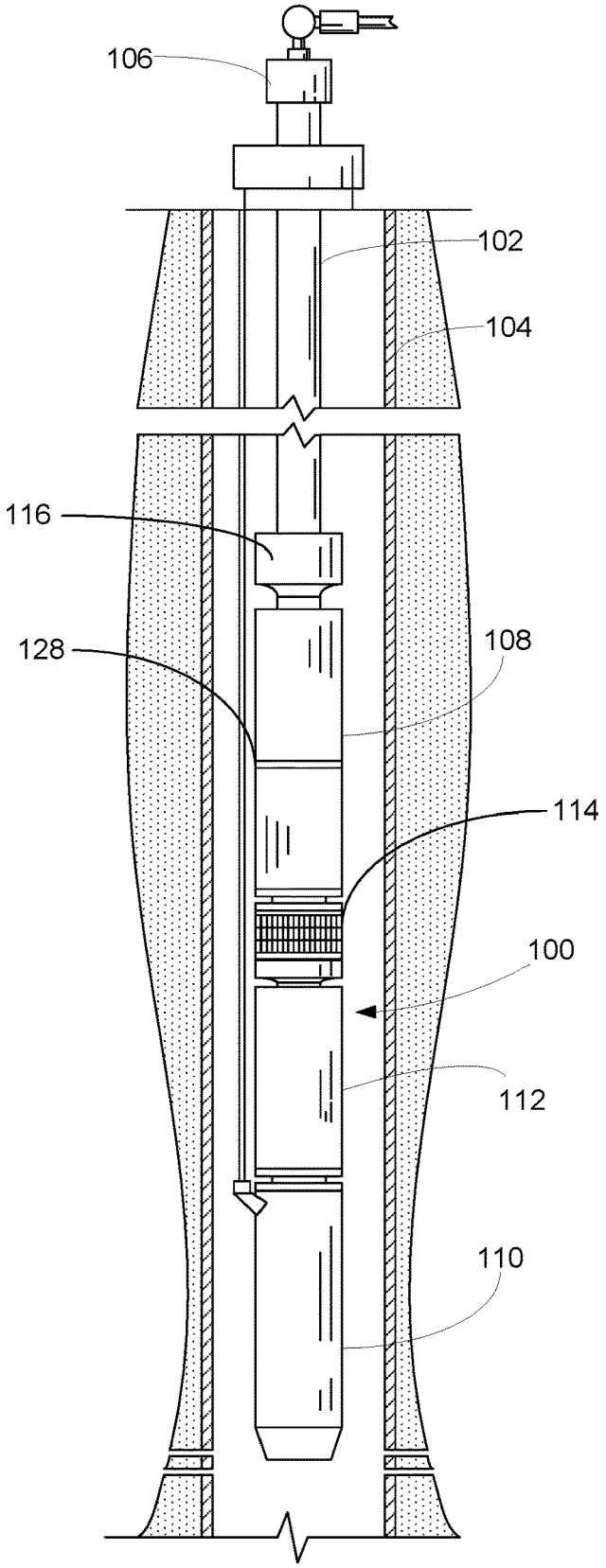
FIG. 1 depicts a submersible pumping system constructed in accordance with exemplary embodiments.

FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 includes a pump 108, a motor 110 and a seal section 112. The seal section 112 shields the motor 110 from mechanical thrust produced by the pump 108. The motor 110 is provided with power from the surface by a power cable. Although only one pump 108 and one motor 110 are shown, it will be understood that more can be connected when appropriate. In the embodiment depicted in FIG. 1, the pump 108 is fitted with an intake 114 to allow well fluids from the wellbore 104 to enter the upstream end of the pump 108. The pump 108 includes a discharge 116 on the downstream end of the pump 108. The discharge 116 can be connected directly or indirectly to the production tubing 102. As used herein, the terms "upstream" and "downstream" refer to components or motion following the direction of fluid flow through the pump 108 (e.g., from the intake 114 to the discharge 116).

Figure 2:
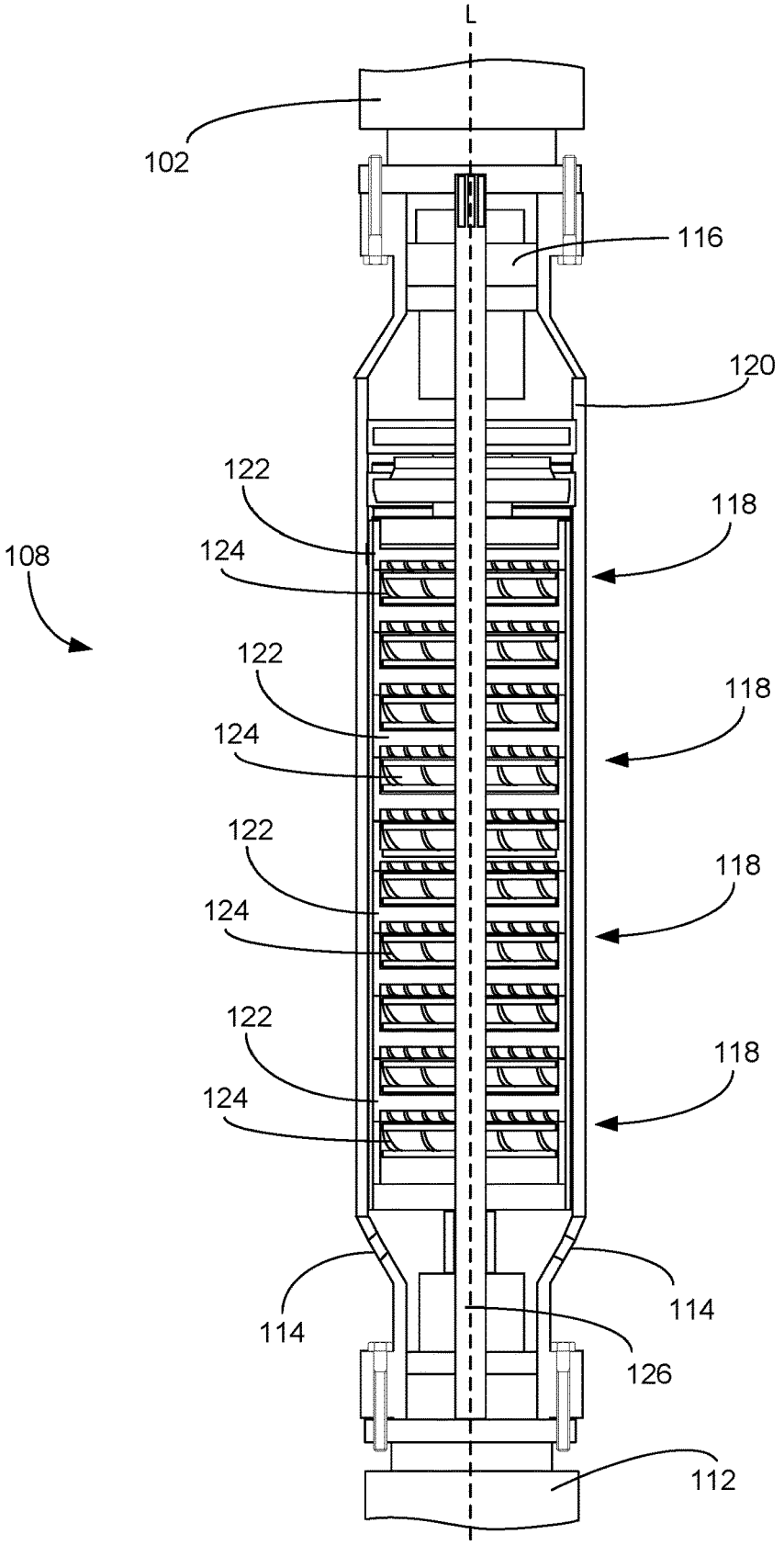
FIG. 2 is a cross-sectional view of the multistage centrifugal pump of FIG. 1.

Turning to FIG. 2, shown therein is a cross-sectional depiction of the pump 108. The pump 108 includes one or more stages 118 contained within a housing 120. Each stage 118 includes a stationary diffuser 122 and a rotatable impeller 124. The pump 108 further includes a centrally disposed shaft 126 that transfers power from the motor 110 to the impellers 124. The impellers 124 are connected to the shaft 126 such that the shaft 126 and impellers 124 rotate together. The impellers 124 can be secured to the shaft 126 through any suitable means, including keyed, press-fit and welded connections. The pump housing 120 is generally cylindrical and the pump 108 has a central longitudinal axis (L) that extends through the center of the shaft 126.

Figure 4A:
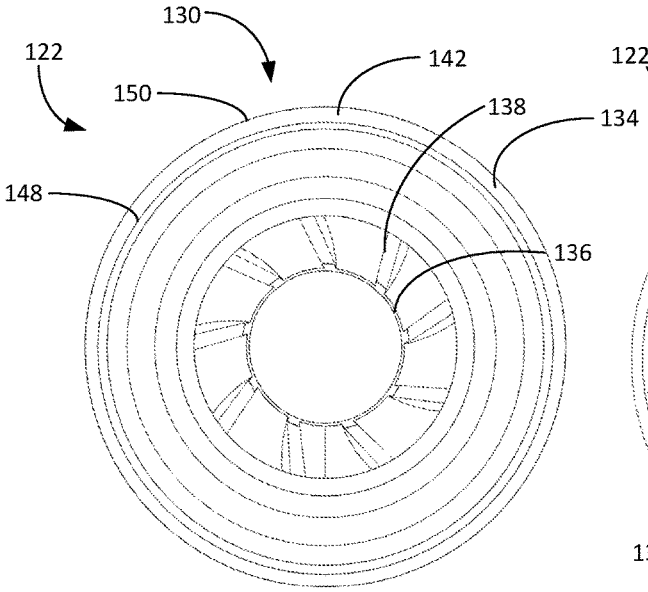
FIGS. 4A-4B provide plan and perspective views, respectively, of the downstream end of a diffuser from the pump of FIG. 1.
Figure 4B:
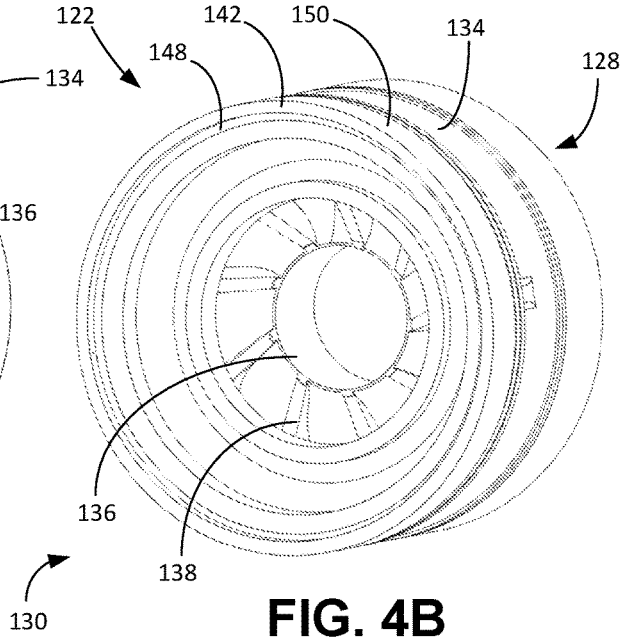
Figure 5A:
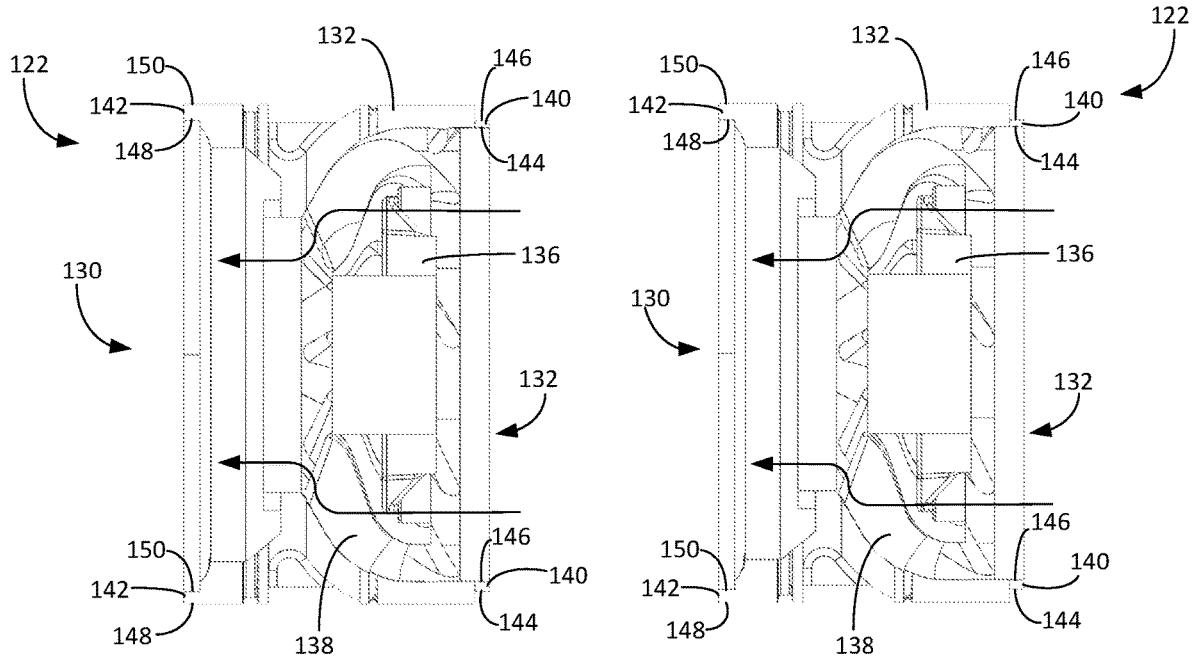
FIG. 5A provides a side cross-sectional view of two diffusers before the diffusers are approximated together in an end-to-end relationship.
Figure 5B:
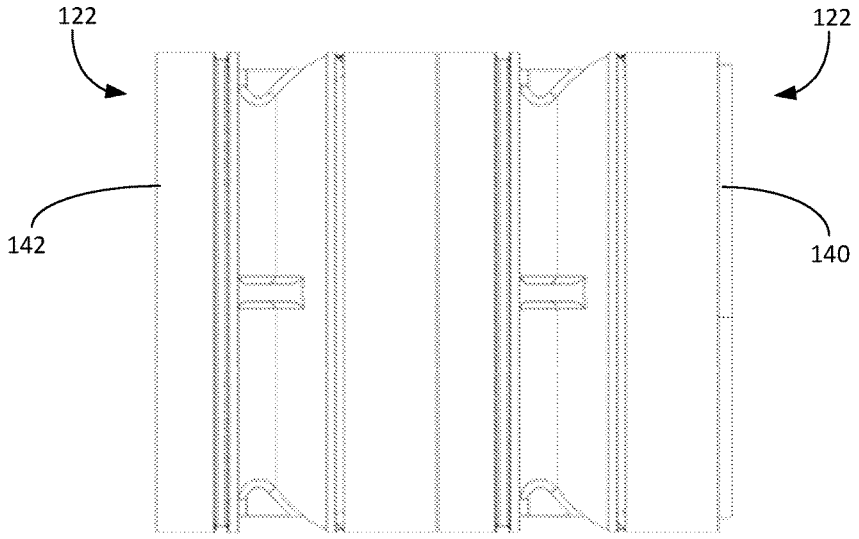
FIG. 5B provides a side view of the two diffusers in FIG. 5A after the diffusers have been approximated into contact.

Turning to FIGS. 3-5, shown therein a various views of a diffuser 122 constructed in accordance with an exemplary embodiment. The diffuser 122 includes an upstream end 128, a downstream end 130, and a central portion 132 between the upstream end 128 and the downstream end 130. The diffuser 122 also includes a shroud 134, a hub 136 and a vane assembly 138. The shroud 134 extends from the downstream end 130 to the upstream end 128. The shroud 134 surrounds the hub 136, the vane assembly 138, and at least an upstream end of the impeller 124 (not shown). The hub 136 is configured to receive the shaft 126 and shaft hub of the impeller 124. The vane assembly 138 generally extends from the upstream end 128 toward the central portion 132 between the shroud 134 and the hub 136 such that fluids passing through the vane assembly 138 are directed inward toward the hub 140 and the center of the downstream impeller 124 in the shroud 138, as illustrated in FIG. 5A.

To optimize pumping efficiency, each diffuser 122 should remain stationary within the housing 120 as the impeller 124 and shaft 126 rotate. Unlike the prior art use of compression sleeves or a key-and-slot combinations, the diffusers 122 constructed in accordance with exemplary embodiments include a keyless nesting mechanism in which a shaped projection 140 on a first end of the diffuser 122 mates within a matching receiver 142 on a second, opposite end of an adjacent diffuser 122. The projection 140 and receiver 142 each have complementary, non-circular shapes that prevent adjacent, nested diffusers 122 from rotating with respect to one another when the projection 140 of a first diffuser 122 is nested within the receiver 142 of an adjacent second diffuser 122.

In the embodiment depicted in FIGS. 3-5, the projection 140 is located on the upstream end 128 of the diffuser 122, while the receiver 142 is located on the downstream end 130 of the diffuser 122. In other embodiments, the projection 140 is located on the downstream end 130 and the receiver is located on the upstream end 128.

Figure 3A:
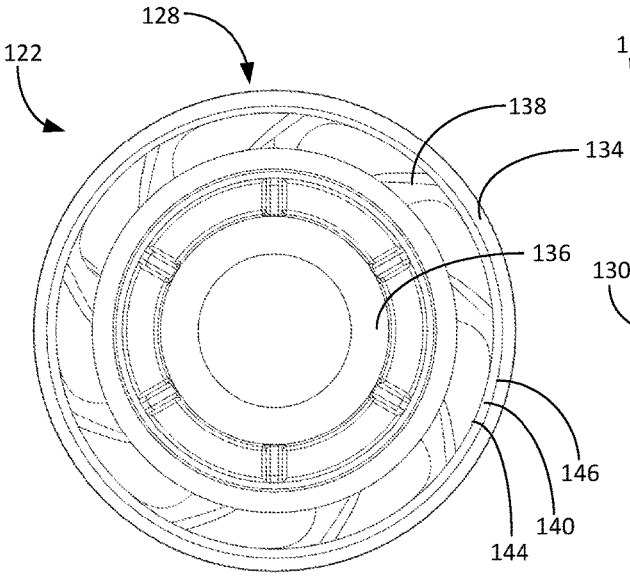
FIGS. 3A-3B provide plan and perspective views, respectively, of the upstream end of a diffuser from the pump of FIG. 1.
Figure 3B:
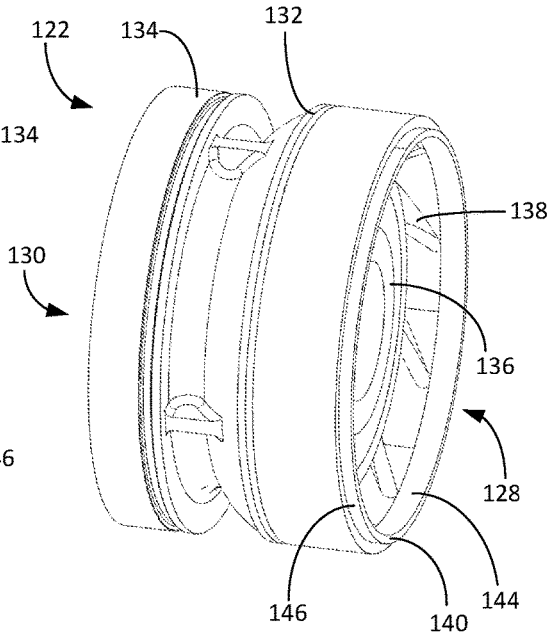

In the embodiment depicted in FIG. 3A, the projection 140 has an oblong or ellipse shape, which can be created by machining or otherwise manufacturing the projection 140 so that it does not have a constant thickness (t). In the embodiment depicted in FIGS. 3A and 3B, the projection 140 has a substantially circular projection inner surface 144 and an oblong projection outer surface 146 such that the projection has thicknesses that range from a maximum thickness ($T_{max}$) to a minimum thickness ($T_{min}$), as best illustrated in the isolated depiction of the projection 140 in FIG. 6A. The variable thickness around the projection outer surface 146 of the projection 140 can be produced during manufacturing by machining progressively more material away from the projection outside surface 146 approaching the point or portion at which the projection 140 reaches its minimum thickness ($T_{min}$). In these embodiments, the inner surface 144 of the projection 140 has a substantially constant diameter, while the outer surface 146 has a variable diameter that is smaller ($D_{min}$) at the portion of minimum thickness ($T_{min}$) and larger ($D_{max}$) at one or more points outside of the portion of minimum thickness ($T_{min}$).

Similarly, in the embodiment depicted in FIGS. 4A and 4B, the receiver 142 has a receiver inner surface 148 with an oblong or ellipse shape that complements the oblong or ellipse shape of the projection outer surface 144. The receiver outer surface 150 can be substantially circular such that it makes good contact with the inside of the housing 120. The receiver inner surface 148 can be created by machining or otherwise manufacturing the receiver 142 so that it does not have a constant thickness (T). In the embodiment depicted in FIGS. 4A and 4B, the receiver 142 has thicknesses that range from a maximum thickness ($T_{max}$) to a minimum thickness ($T_{min}$). As best illustrated in the isolated depiction of the receiver 142 shown in FIG. 6B, the variable thickness around the receiver inner surface 148 can be produced during machining progressively more material away from the receiver inner surface 148 approaching the point or portion of the receiver 142 that has the minimum thickness ($T_{min}$). In these embodiments, the receiver inner surface 148 has a variable diameter that is smaller ($D_{min}$) at the portion of minimum thickness ($T_{min}$) and larger ($D_{max}$) at one or more points outside spaced apart from the point of minimum thickness ($T_{min}$).

Figure 6A:
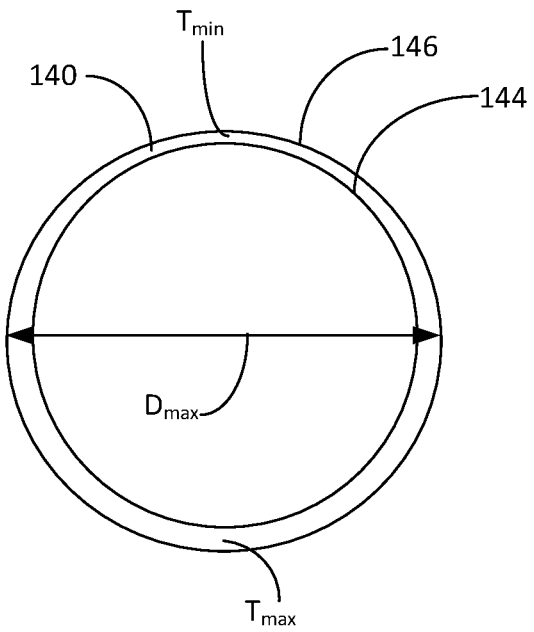
FIGS. 6A-6B depict the isolated projection and mating receiver.
Figure 6B:
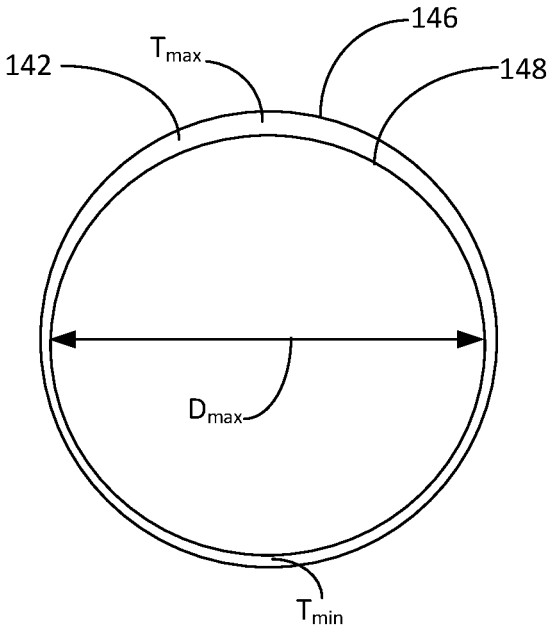
Figure 6C:
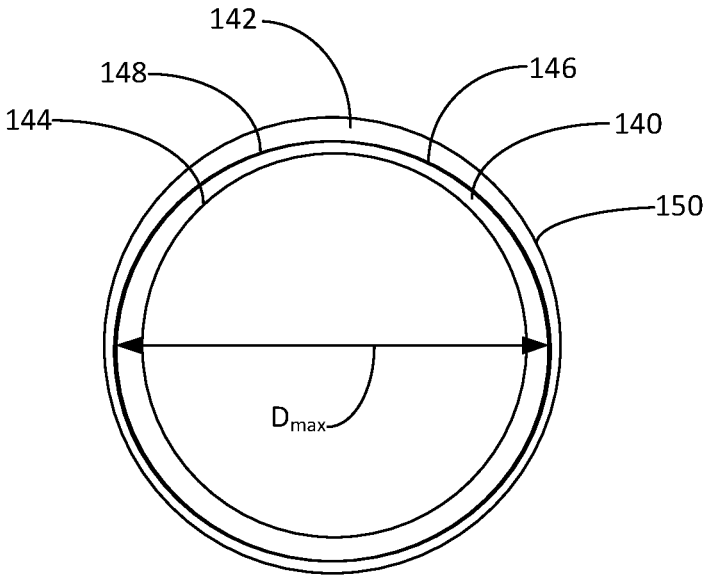
FIG. 6C depicts the interconnection between the projection and the mating receiver of FIGS. 6A-6B nested together.

As best illustrated in FIGS. 6A-6C, the projection 140 and receiver 142 include complementary shapes such that the projection 140 fits inside the receiver 142 only when the largest diameter ($D_{max}$) of the projection outer surface 146 is aligned with the largest diameter ($D_{max}$) of the receiver inner surface 148, and the smallest diameter ($D_{min}$) of the projection outer surface 146 is aligned with the smallest diameter ($D_{min}$) of the receiver inner surface 148. Once the projection 140 is nested inside the receiver 142, the adjacent diffusers 122 are prevented from rotating with respect to one another because the largest diameter ($D_{max}$) of the projection outer surface 146 can only fit inside the portion of the receiver inner surface 148 with nominally the same maximum diameter ($D_{max}$), as depicted in FIG. 6C. Rotation in either direction is prevented by interference between the portion of the projection outer surface 146 with the largest diameter ($D_{max}$) and any portion of the receiver inner surface 148 other than the portion with the common maximum outer diameter ($D_{max}$).

Thus, a series of adjacent diffusers 122 can be ganged together in this nested configuration to prevent the entire line of diffusers 122 from rotating with respect to one another within the pump housing 120. One or more of the diffusers 122 can be connected to the housing 120 or another fixed component within the pump 108 using conventional mechanisms, such as a slot-and-key arrangement. The incorporation of the projection 140 and receiver 142 in the diffusers 122 provides a cost-effective and efficient nesting mechanism for preventing the rotation between adjacent diffusers 122.

Although the projection 140 and receiver 142 have been disclosed as having oblong or ellipse shapes, in other embodiments the receiver 142 and projection 142 have other non-circular shapes, including oval shapes and lobed shapes, where the shape and size of the projection outer surface 146 cannot rotate within the receiver inner surface 148 once the projection 140 has been nested inside the receiver 142. In exemplary embodiments, the projection 140 and receiver 142 include complementarily shaped mating surfaces that can be efficiently and cost-effectively manufactured. It will be appreciated that the anti-rotation nesting mechanism based on the projection 140 and receiver 142 can be applied to diffusers other than the specific diffuser 122 depicted in FIGS. 3-5.

In some embodiments, diffusers 122 within the same pump housing 120 will have differently shaped projections 140 and receivers 142. Using multiple sets of matching projections 140 and receivers 142 can facilitate assembly of the pump 108, particularly where different diffusers are used within the same pump 108, by ensuring the diffuser 122 and impellers 124 are properly ordered during assembly. For example, diffusers 122 in radial flow stages 118 near the intake 114 can be provided with a first set of matching projections 140 and recesses 142, while diffusers 122 in axial flow stages 118 near the discharge 116 are provided with a second set of matching projections 140 and recesses 142, where the first and second set of matching projections 140 and recesses 142 are not interchangeable.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pumping system comprising:

a motor; and a pump driven by the motor, wherein the pump comprises a housing and first and second pump stages inside the housing, wherein the pump further comprises:

a first impeller within the first pump stage;

a first diffuser within the first pump stage, wherein the first diffuser comprises a first end, a second end, and a projection on the second end, wherein the projection has a continuously curved projection outer surface that has a non-circular shape and a projection inner surface, wherein the projection has a variable thickness between the projection outer surface and the projection inner surface;

a second impeller within the second pump stage;

a second diffuser within the second pump stage, wherein the second diffuser comprises a first end, a second end, and a receiver on the first end, wherein the receiver comprises a receiver inner surface that has a continuously curved non-circular shape that is complementary to the continuously curved non-circular shape of the projection outer surface of the first diffuser; and wherein the projection of the first diffuser nests within the receiver of the second diffuser in only a single orientation such that the first diffuser cannot rotate with respect to the second diffuser.

2. The pumping system of claim 1, wherein the first stage is upstream from the second stage inside the housing of the pump.

3. The pumping system of claim 2, wherein the first end of the first diffuser is an upstream end and the second end of the first diffuser is a downstream end.

4. The pumping system of claim 2, wherein the first end of the second diffuser is an upstream end and the second end of the second diffuser is a downstream end.

5. The pumping system of claim 1, wherein the non-circular shape is oblong.

6. The pumping system of claim 1, wherein the second diffuser is rotationally oriented with respect to the first diffuser such that the non-circular shape of the projection outer surface of the first diffuser is complementarily arranged with the non-circular shape of the receiver inner surface of the second diffuser.

7. The pumping system of claim 1, wherein the projection outer surface of the first diffuser has a maximum diameter ($D_{max}$).

8. The pumping system of claim 7, wherein the receiver inner surface of the second diffuser has a maximum diameter ($D_{max}$) that is the same as the maximum diameter ($D_{max}$) of the projection outer surface of the first diffuser.

9. The pumping system of claim 8, wherein the second diffuser is rotationally oriented with respect to the first diffuser such that maximum diameter ($D_{max}$) of the receiver inner surface of the second diffuser is aligned with the maximum diameter ($D_{max}$) of the projection outer surface of the first diffuser when the first and second diffusers are nested together.

10. The pumping system of claim 1, wherein the first and second diffusers each further comprise:

a shroud;

a hub; and a vane assembly connected between the shroud and the hub.

11. The pumping system of claim 1, wherein the receiver of the second diffuser comprises a receiver outer surface that is in contact with the housing.

12. The pumping system of claim 1, wherein the pumping system is a submersible pumping system.

13. The pumping system of claim 5, wherein the non-circular shape of the axial flow diffuser receiver is not oblong.

14. A pump for use within a pumping system, wherein the pump comprises:

a first stage that includes a first impeller and a first diffuser;

a second stage adjacent to the first stage, wherein the second stage includes a second impeller and a second diffuser;

wherein the first diffuser and second diffuser each include means for nesting the first diffuser and second diffuser together in a rotationally fixed arrangement;

a third stage that includes a third impeller and a third diffuser;

a fourth stage adjacent to the third stage, wherein the fourth stage includes a fourth impeller and a fourth diffuser; and wherein the third diffuser and fourth diffuser each include means for nesting the third diffuser and fourth diffuser together in a rotationally fixed arrangement, wherein the means for nesting the third diffuser and fourth diffuser together prevent the third diffuser from nesting with the second diffuser.

15. A pump for use in a pumping system, the pump comprising:

a pump housing;

a first diffuser inside the pump housing, wherein the first diffuser comprises:

a first end having a first diffuser receiver; and a second end having a first diffuser projection, wherein the first diffuser projection has a non-circular first diffuser projection outer surface;

a second diffuser adjacent to the first diffuser inside the pump housing, wherein the second diffuser comprises:

a first end having a second diffuser receiver, wherein the second diffuser receiver has a non-circular second diffuser receiver inner surface that matches the non-circular first diffuser projection outer surface; and a second end having a second diffuser projection; and wherein the first diffuser projection nests within the second diffuser receiver to prevent the second diffuser from rotating with respect to the first diffuser; and a third diffuser inside the pump housing, wherein the third diffuser comprises:

a first end having a third diffuser receiver, wherein the third diffuser receiver has a third diffuser receiver inner surface that does not match the non-circular first diffuser projection outer surface.

* * * * *